US007784962B2

(12) United States Patent
Hockel et al.

(10) Patent No.: US 7,784,962 B2
(45) Date of Patent: Aug. 31, 2010

(54) TEMPERATURE AND LIGHTING CONTROL DEVICE

(75) Inventors: Jens Florian Hockel, Munich (DE); Harald Stoyan, Regensburg (DE)

(73) Assignee: Osram Gesellschaft mit beschränkter Haftung, Munich (DE)

( * ) Notice: Subject to any disclaimer, the term of this patent is extended or adjusted under 35 U.S.C. 154(b) by 239 days.

(21) Appl. No.: 11/748,290

(22) Filed: May 14, 2007

(65) Prior Publication Data

US 2007/0263386 A1 Nov. 15, 2007

(30) Foreign Application Priority Data

May 12, 2006 (DE) ..... 10 2006 022 351

(51) Int. Cl.
*F21S 8/00* (2006.01)
*F21V 29/00* (2006.01)

(52) U.S. Cl. ..... 362/147; 362/249.02; 362/294; 362/373; 362/253

(58) Field of Classification Search ..... 362/147, 362/148, 294, 373, 249.02, 253
See application file for complete search history.

(56) References Cited

U.S. PATENT DOCUMENTS

| | | | | |
|---|---|---|---|---|
| 3,818,653 | A * | 6/1974 | Williams | 52/79.1 |
| 4,222,316 | A | 9/1980 | Adam | |
| 6,160,956 | A * | 12/2000 | Pelonis | 392/361 |
| 7,473,010 | B2 * | 1/2009 | O'Brien et al. | 362/293 |
| 7,494,244 | B1 * | 2/2009 | Van Diep et al. | 362/234 |
| 2005/0184651 | A1 | 8/2005 | Cheng et al. | |
| 2005/0279949 | A1 * | 12/2005 | Oldham et al. | 250/458.1 |
| 2007/0121324 | A1 * | 5/2007 | Nakano | 362/276 |

FOREIGN PATENT DOCUMENTS

| | | |
|---|---|---|
| CH | 589825 | 7/1977 |
| DE | 2 246 862 A1 | 9/1972 |
| DE | 24 31 118 A1 | 2/1975 |
| DE | 24 46 166 A1 | 4/1976 |
| DE | 40 04 210 A1 | 9/1990 |
| DE | 198 37 501 A1 | 10/1999 |
| DE | 199 00 735 A1 | 7/2000 |
| DE | 20 2005 002110 U1 | 6/2005 |
| DE | 102004001193 A1 | 7/2005 |
| GB | 1 374 060 | 11/1974 |

* cited by examiner

*Primary Examiner*—Stephen F Husar
*Assistant Examiner*—James W Cranson
(74) *Attorney, Agent, or Firm*—Fish & Richardson P.C.

(57) ABSTRACT

The present invention relates to a device for controlling room temperature and room lighting wherein the device comprises a temperature control system for the receipt and/or delivery of heat to the surroundings and a lighting system wherein the lighting system is thermally coupled to sections of the temperature control system.

20 Claims, 3 Drawing Sheets

TEMPERATURE AND LIGHTING CONTROL DEVICE

CROSS REFERENCE TO RELATED APPLICATION

This patent application claims the priority of German patent application 10 2006 022 351.9, filed May 12, 2006.

BACKGROUND

Temperature regulation devices are described.

Controlling the temperature and climate, especially heating and cooling, of large facilities such as department stores, office complexes or large manufacturing facilities usually requires extensive air conditioner units. In addition, the large lighting systems required for such facilities produce high heat drag-in due to the high amount of waste heat generated by the lighting system, which in turn necessitates expensive insulation measures in addition to cooling by means of air conditioner units. Such air conditioner units and lighting systems often contribute considerably to energy consumption in large facilities.

SUMMARY

A device that reduces the energy consumed by room temperature control systems and lighting systems and thus contributes to reducing operating costs is described.

In one embodiment, a device for controlling room temperature and lighting includes, among other things, a temperature control system for receiving and/or delivering heat to the surroundings and a lighting system thermally coupled to sections of the room temperature control system.

A temperature control system may be a system or a device that increases the temperature in the surroundings by delivering heat to the surroundings in the form of a heater, or lowers the temperature of the surroundings by receiving heat from the surroundings in the form of a cooling unit. The surroundings of the temperature control system may be a room in which the temperature control system is located as a room temperature control system. The room temperature control system advantageously may also be adjacent to the room.

In addition to emitting light, operating the lighting system generates waste heat that the lighting system may deliver to the room temperature control system, because the lighting system is thermally coupled to the room temperature control system. This can imply that there is no thermal insulation directly between the lighting system and the room temperature control system so that there can be free heat transmission between the lighting system and the room temperature control system. Heat from the light is delivered to the temperature control system without going through the environment or the surroundings. For example, the heat can be carried through pipes or by direct contact with the temperature control system. Here it may be advantageous if the lighting system delivers the generated waste heat only to the room temperature control system, and not, or only on a small scale, to the surroundings, e.g., a room. This allows for an effective cooling of the lighting system by means of the room temperature control system.

In another embodiment of the device the lighting system comprises a carrier means with at least one attached light-emitting component arranged on the carrier means. The carrier means may include a carrier plate, such as a printed circuit board, a socket or any other suitable electric contact device. The carrier means can be arranged inside a housing or may be an integral part of a housing. The housing may have an opening through which emitted light from the light-emitting component may exit the housing. The housing, or at least parts thereof, may include aluminum or copper or may be made of aluminum or copper. Alternatively or additionally the housing may include other materials, such as other metals or non-metals or may be made of other metals or non-metals. In particular, the carrier means can include the same material as or a different material than the housing.

In one embodiment the lighting system includes light-emitting diodes (LEDs). The lighting system can include surface-mounted LEDs that are arranged on and attached to, for example by soldering, a carrier means, such as a carrier plate, a printed circuit board or a correspondingly suitable device of the lighting system. A surface-mounted LED may have, for example, a contact surface between the LED and the carrier means. Waste heat that is generated during operation can be effectively delivered to the room temperature control system via the contact surface so that only a little or almost no waste heat is delivered in the light emission direction. This configuration can be used in a bright lighting system having a plurality of LEDs with high light emission capacity attached to the carrier means. Due to the good thermal coupling of the LEDs to the carrier means, the waste heat is advantageously delivered to a housing via the contact surfaces. LEDs with high light emission capacity typically generate waste heat in the range of 1 watt or more.

Additionally or alternatively, the lighting system may also include other light-emitting components, for example solderable LEDs or light-emitting components using halogen technology, such as halogen lamps. For fastening halogen light-emitting components, for example, the lighting system may include sockets or other electric contacts through which a part of the waste heat generated during operation is delivered to the carrier means and thus advantageously to the housing. Another part of the waste heat generated during operation may be delivered to the housing through convection. A lighting system that comprises light-emitting components and in which at least part of the waste heat also is delivered in the direction of light emission, advantageously may comprise light transparent but heat reflecting means, such as a heat reflecting piece of glass, in the beam path of the light-emitting components, i.e., a cover over the opening of the housing.

In an embodiment of the device, a light-emitting means includes a component that is in the light path of the light emitter that restricts the solid angle into which the light can be emitted, e.g., a mask, a diaphragm, an aperture or a beam shaping element. That is, the light-emitting means can have a component that causes the means to radiate light only within a limited space. Herein, this component is referred to as a beam shaping attachment. Such a beam shaping attachment may be a suitably shaped light modifier, for example a parabolic concave mirror or a so-called parabolic, elliptic or hyperbolic concentrator. Alternatively or additionally a beam shaping attachment may include additional optical elements such as a lens, a diffuser or a diffusing panel or a wavelength converter.

The lighting system may form direct light radiation. This means, in particular, that the opening of the housing is arranged in the direct path of the beam from the light-emitting means. In particular, the lighting system may include a plurality of light-emitting means with openings in the housing located in the direct paths of the light-emitting means. Alternatively, the light that is emitted by a plurality of light-emitting means may exit the lighting system through the same opening. Furthermore, the lighting system may form indirect light radiation. This means, in particular, that the light of one or a plurality of light-emitting means is reflected toward an opening of the housing via reflecting means, such as mirrors or reflective inside walls, e.g., coated inside walls of the housing. The light emitted from the light-emitting means can be radiated into a reflecting cavity (e.g., mirrored inside walls of the housing) and, following the reflection on the reflective cavity, may be directed out of the lighting system, e.g., through the above mentioned openings in the housing. The light that is emitted from a plurality of, for example, multi-colored light-emitting means may be superimposed prior to exiting through the opening of the housing so that an observer's impression of the colors corresponds to the overall spectrum of the multi-colored light-emitting means. Furthermore, the reflecting cavity, e.g., a reflecting means or reflective inside walls of the housing, may reflect the light emitted by one or by the plurality of the light-emitting means and transmit heat. Thus, waste heat delivered in the direction of the light emission is transmitted to the housing.

In an embodiment of the device the receipt of heat from the surroundings and/or delivery of heat to the surroundings occurs across a large area. This means, in particular, that the room temperature control system is in thermal contact with a large area of the room to which it is adjacent or in which it is located. That is, the control system does not merely transfer heat to or from a room with a single small heat exchange area, e.g., a one foot by one foot heat inlet or outlet. The heat transfer can occur across several heating or cooling outlets or transfer components in a single room or may cover a large portion of a wall or ceiling, such as greater than 5%, 10%, 20%, 25% or 50% of the wall or ceiling. In some embodiments, the heat exchange area is greater than two feet by two feet, or is greater than four feet by four feet. It may be advantageous for the room temperature control system to have a thermal coupler means that is a linear system with a heat transmitting medium, such as a pipe filled with fluid. Such a heat transmitting medium may have a high heat capacity, for example, and may be water, for example, or a mixture of water and suitable additives. Also possible are other heat transmitting media such as a gas, e.g., air or nitrogen, or liquid, e.g., ethanol, water or nitrogen. Alternatively or additionally the room temperature control system also may include heat conducting sections.

In an embodiment of the device the heat of the room temperature control system is received from or delivered to the surroundings, in particular a room, through convection. Alternatively or additionally the receipt of heat from or delivery of heat to the surroundings may be based on the flow of air. This means, in particular, that the room temperature control system includes a thermal coupler means that is a suitable air flow device, such as ventilators, fans or blowers that either allow the flow of air from the room temperature control system into the room or a flow of air from the room to the room temperature control system or both.

The room temperature control system may be an air conditioner unit or at least a part thereof. In one embodiment of the device, the room temperature control system is integrated into the ceiling or a wall of a room in which the temperature is to be controlled. In particular, the room temperature control system advantageously may be a part of a so-called climate control ceiling or climate control wall. This means that the large area arrangement of the room temperature control system in the ceiling or wall of the room allows for a large area exchange of heat with the room and thus allows the control of the room temperature.

In another embodiment of the device, the lighting system is in direct contact with the room temperature control system. This means, in particular, that at least parts of the housing or at least parts of the carrier means of the lighting system are in direct contact with the room temperature control system. Waste heat generated during the operation of the light-emitting means of the lighting system that is delivered to the housing or the carrier means is further delivered to the room temperature control system. The lighting system advantageously delivers the waste heat generated during operation to the heat-storing medium in sections of the room temperature control system. The direct contact between the lighting system and the room temperature control system advantageously ensures good thermal coupling of the lighting system to the room temperature control system.

Alternatively or additionally sections of the lighting system may be thermally coupled to the room temperature control system via a heat conductor means. Materials with good thermal conducting properties, such as metals, for example copper or aluminum, can be used to create a heat conductor. A heat conductor may be in direct contact with the lighting system and the room temperature control system, and a heat conductor means for making direct contact can be a sheet, plate, bar, or bulk piece of thermally conductive material. In some embodiments, the contact between the heat conductor and the lighting system and/or the contact between the heat conductor and the room temperature control system is across a large area, i.e., the thermal contact occurs via a back surface or a side surface of the lighting system that is in thermal contact with the heat conductor as a whole. Furthermore in some embodiments the heat conductor includes a heat transporting medium. An example of a heat conductor means using a heat transporting medium is a heat conductor in which heat is effectively transported from a first end to a second end based on evaporation of a liquid in a first end and condensation to liquid at the second end of the heat conductor. Such a heat conductor also is called a "heat pipe". A heat conductor may be part of the lighting system, in particular the housing.

Alternatively or additionally the thermal coupling of the lighting system to the room temperature control system may be through convection and/or flow of air. Here it is advantageous when the flow of air is generated by suitable heat conductor means, such as blowers, fans or a ventilator which is part of the lighting system, for example. A blower or ventilator may be advantageous, in particular, when the waste heat generated during operation of the light-emitting means is delivered not only via a contact surface of the light-emitting means with the carrier means or the housing but also is radiated in the direction of the light emission, for example. The housing may include suitable openings such as slots or holes on the side facing the room temperature control system, which ensures good thermal coupling.

An advantageous use of the device with a lighting system and a room temperature control system is possible when the lighting system is in thermal contact with the room temperature control system and the waste heat of the lighting system is delivered to the room temperature control system.

Another advantageous way to use the device is to deliver the waste heat generated by the lighting system to the room, where the waste heat is either the only source of heat or the main source of heat supplied by the room temperature control system. The room temperature control system can be used, for example, to deliver the waste heat generated by the lighting system during operation to the room across a large area, which allows for an even control of the room temperature. By delivering the waste heat of the lighting system to the room temperature control system, extensive cooling of the lighting system is not necessary. Additionally, using the device reduces separate heat delivery for the room temperature control system or might even make it completely unnecessary.

The use of the device thus results in a less complicated room temperature control system from a technical point of view since it is possible that only one cooling system is required for the room temperature control system. Depending on the desired room temperature, all of the waste heat from the lighting system may be used or parts of it may be removed from the room temperature control system for cooling purposes so that only some of the waste heat of the lighting system is available for delivery to the room. Furthermore, all of the waste heat of the lighting system may be dissipated by cooling the room temperature control system. Advantageously the cooling capacity of the room temperature control system may be higher than the waste heat of the lighting system so that the device can be used for cooling as well as heating the surroundings, in particular a room.

In embodiments, the device can have significantly lower energy consumption and thus result in lower costs.

Further advantages and advantageous embodiments and further developments of the invention are disclosed in the explanation of the following exemplary embodiments in connection with the Figures.

In the exemplary embodiments and Figures identical or identically acting components have the same reference number. The means that are shown and their ratio of dimensions with respect to each other as a rule are not to scale; rather individual means can be shown exceedingly large to provide a better view and/or better understanding.

DETAILED DESCRIPTION

The temperature control systems described herein can be used within a building, such as a room or space in a commercial or residential building. A temperature control system is a device that draws in air from the room, from another room in the building or from outside the building. The temperature control system then directs the air to a thermal exchange system, that is, the system changes the temperature of the air, such as by heating or cooling the air, and transfers the warmed or cooled air into the room or space that requires heating or cooling. The air that has been heated or cooled can be blown or pumped into the room. The temperature control system is in some embodiments an air conditioner or a heater.

Figure 1A:
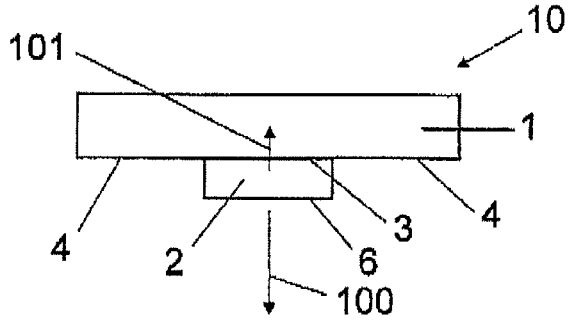
FIGS. 1A and 1B show schematic profiles of devices described herein.

The device 10 shown in the exemplary embodiment of FIG. 1A shows a temperature control system 1 to which a lighting system 2 is thermally coupled. The thermal coupling is provided by the surface 3 of the temperature control system 1 that provides part of the overall surface of the temperature control system 1. The temperature control system 1 exchanges heat with the surroundings, in particular delivering heat to the surroundings or receiving heat from the surroundings, via surface 4. The lighting system 2 supplies light 100 to the surroundings across surface 6. In the exemplary embodiment shown in FIG. 1A the lighting system 2 is in direct contact with the temperature control system 1. The waste heat 101 generated during the operation of the lighting system 2 is carried off to the temperature control system 1 via the thermal coupling of the lighting system 2 to the temperature control system 1.

Figure 1B:
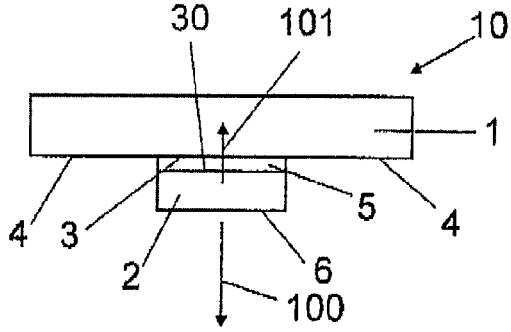

The exemplary embodiment in FIG. 1B shows a device in which the lighting system 2 is in thermal contact with the temperature control system 1 via a conveyor 5. Conveyor 5 can be used if it is not possible to have direct contact between the lighting means 2 and the temperature control system 1 due to space restrictions. The conveyor 5 can conduct heated air, heated gases or heated fluid to the temperature control system 1. The conveyor 5 may be several centimeters wide, for example 5 centimeters. At least sections of the conveyor 5 can include heat conducting material. For example, such heat conducting material can be copper or aluminum. The heat conducting material can also provide a mechanical coupling of the lighting system 2 to the temperature control system 1. If at least sections of the conveyor 5 include a heat transporting medium, such as suitable liquid that evaporates on the surface 30 by taking up heat from the lighting system 2 and that condenses again when heat is delivered to the surface 3 of the temperature control system 1, the heat generated by the lighting system 2 is effectively transported to the temperature control system 1. The heat transporting medium can also be steam. An advantageous embodiment of conveyor 5 thus includes sections that have a heat transporting medium, so-called "heat pipes", for example. The conveyor 5 additionally or alternatively can have sections without material in which the heat from the lighting system 2 is transported to the temperature control system 1 through convection or air flow.

In the exemplary embodiments shown in FIGS. 1A and 1B, the waste heat 101 generated in the lighting system 2 during operation can be carried off to the temperature control system 1. The waste heat 101 that is delivered to the temperature control system 1 in this manner either can be carried off by the temperature control system 1 through cooling or can be at least partially delivered to the surroundings, e.g. a room in which the temperature is controlled, via the surfaces 4.

Figure 2A:
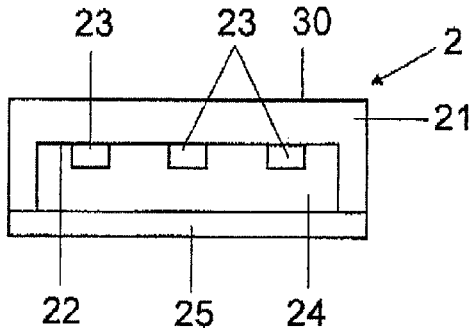
FIGS. 2A and 2B show schematic profiles of lighting systems.
Figure 2B:
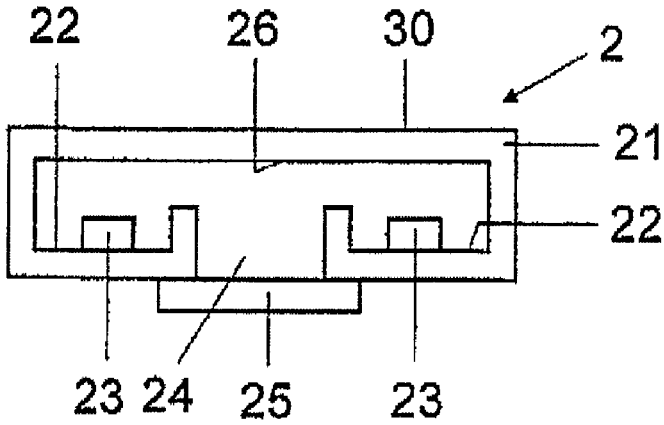

The exemplary embodiments shown in FIGS. 2A and 2B are examples of lightings systems 2 that may be connected to a temperature control system analogously to FIGS. 1A and 1B. The lighting system 2 shown in FIG. 2A has a housing 21 with a carrier means 22. Light-emitting means 23 are attached to the carrier means 22 that radiate light in the direction of the opening 24 of the housing 21. Additionally a cover 25 may be arranged over the opening 24. The light-emitting means 23 may be LEDs, for example, that have a high lighting capacity.

Such LEDs may have a waste heat capacity ranging around 1 watt or more. The waste heat is conducted via the carrier means 22 to the housing 21 and from there to the temperature control system 1, in particular if the LEDs are surface-mounted LEDs that are thermally coupled to the carrier means 22. It is possible to use LEDs that are operated at a temperature below 150° C., such as at a temperature below 85° C., or at a temperature below 60° C. If the temperature of the LEDs ranges above 150° C., the high temperature can have a negative effect on the function of the LEDs. Therefore, carrying off the waste heat of the light-emitting means 23 to the housing 21 may be advantageous for the reliable operation of the lighting system.

Alternatively, some of the light-emitting means can be halogen lamps that radiate waste heat in the direction of the light emission, i.e., in the direction of the opening 24. In this case the cover 25 can include a heat reflecting coating or a heat reflecting means so that the waste heat radiated in the direction of the opening 24 is reflected back in the direction of the housing 21. The heat that the light-emitting means 23 deliver to the housing 21 may be supplied via the surface 30 as is shown in the exemplary embodiments of FIGS. 1A and 1B. The lighting system 2 shown in FIG. 2A forms direct light radiation. The light-emitting means 23 may include beam shaping attachments (not shown), for example a suitably shaped concentrator, for example a parabolic concave mirror or a so-called parabolic, elliptic or hyperbolic concentrator.

Alternatively or additionally a beam shaping attachment can include additional optical elements such as a lens, a diffuser, a diffusion panel, or a wavelength converter. The light-emitting means 23 can have identical or different emissions spectra. The cover 25 alternatively or additionally may include optical means such as one or a plurality of lenses or lens structures or a diffuser such as a diffusion panel.

The lighting system 2 shown in FIG. 2B includes a housing 21 with a carrier means 22 with the carrier means arranged on the side of the opening 24. Light-emitting means 23 are arranged on the carrier means 22 and radiate light in the direction of the inside surface of the housing 26. The inside surface of the housing 26 can be reflective so that the light radiated by the light-emitting means 23 exits the opening 24 by way of reflection on the inside surface of the housing 26. The lighting system 2 shown in FIG. 2B thus forms indirect light radiation. Due to indirect radiation a light mixture of the emissions spectra of the individual light-emitting means 23 can be accomplished inside the housing 21 so that the light that exits through opening 24 has a spectrum that corresponds to an at least partial mixture of the spectra of the individual light-emitting means. A cover 25 that is transparent to the exiting light is arranged over the opening 24 with the cover corresponding to the one described in the exemplary embodiment in FIG. 2A.

A lighting means 2 according to FIGS. 2A and 2B additionally may include a blower, a fan or ventilator (not shown) inside or outside of the housing 21 to allow for an effective carrying off of the air flow. The housing 21 may have holes or slots on one side, such as the one that faces away from the opening 24.

Figure 3:
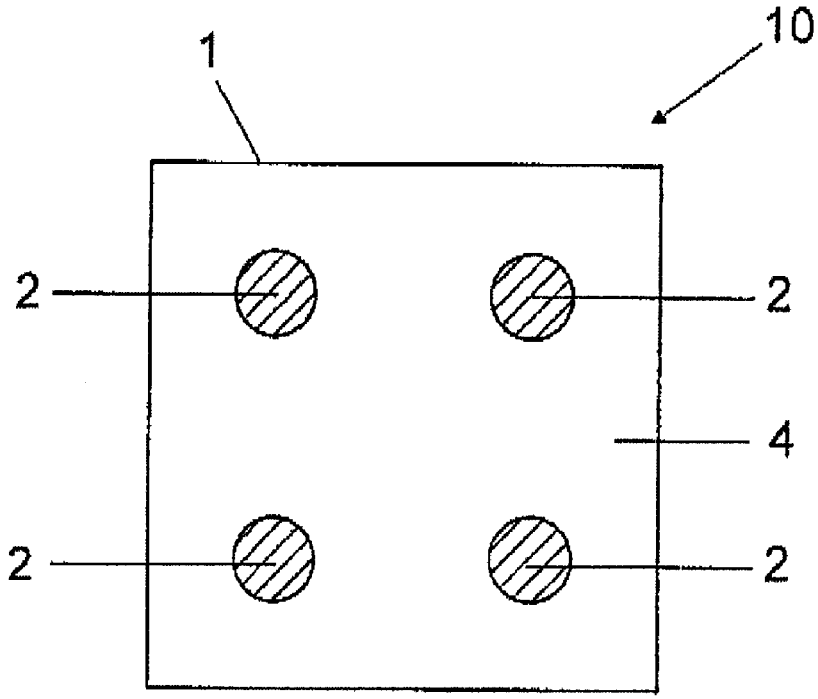
FIG. 3 shows a schematic profile of a device described herein.

The exemplary embodiment according to FIG. 3 shows a device 10 seen from the top of the lighting system 2 that may correspond to the exemplary embodiments of FIGS. 1A and 1B. Here, a lighting system 2 includes multiple lighting units and is arranged in several sections of a temperature control system 1. The arrangement, shape and number of the lighting units of the lighting system 2 are merely exemplary and not limited to the device shown.

For example, a device 10 may include a lighting system 2 having 28 individual lighting units according to the exemplary embodiment in FIG. 2A, with each individual lighting units in turn comprising 2 LEDs and 4 halogen lamps. Each LED may generate waste heat of 1.2 watts and each halogen lamp may generate waste heat of 50 watts. This means the lighting system generates total waste heat of approximately 6.4 kilowatts. Thus it may be advantageous for the temperature control system 1 to have a cooling capacity in excess of approximately 6400 watts, for example 11 kilowatts. By effectively carrying off waste heat from the lighting system 2 to the temperature control system 1, it is possible to deliver to the surroundings a heat capacity that approximately corresponds to the waste heat capacity of the lighting system 2. That is, heat from the lighting system 2 can be transferred to a room by the surface 4 of the temperature control system. If the cooling capacity of the temperature control system 1 exceeds the waste heat capacity of the lighting system 2, it is possible to cool the surroundings, for example a room, via surface 4 of the temperature control system.

Alternatively, a device 10 may include a lighting system 2 having 28 individual lighting units according to the exemplary embodiment in FIG. 2B with each individual lighting units in turn comprising 40 LEDs and 4 halogen lamps. Each LED may generate waste heat of 1.2 watts and each halogen lamp may produce waste heat of 150 watts. This means the lighting system produces total waste heat of 18 kilowatts. Thus it may be advantageous for the temperature control system to generate a cooling capacity in excess of approximately 18 kilowatts.

Figure 4A:
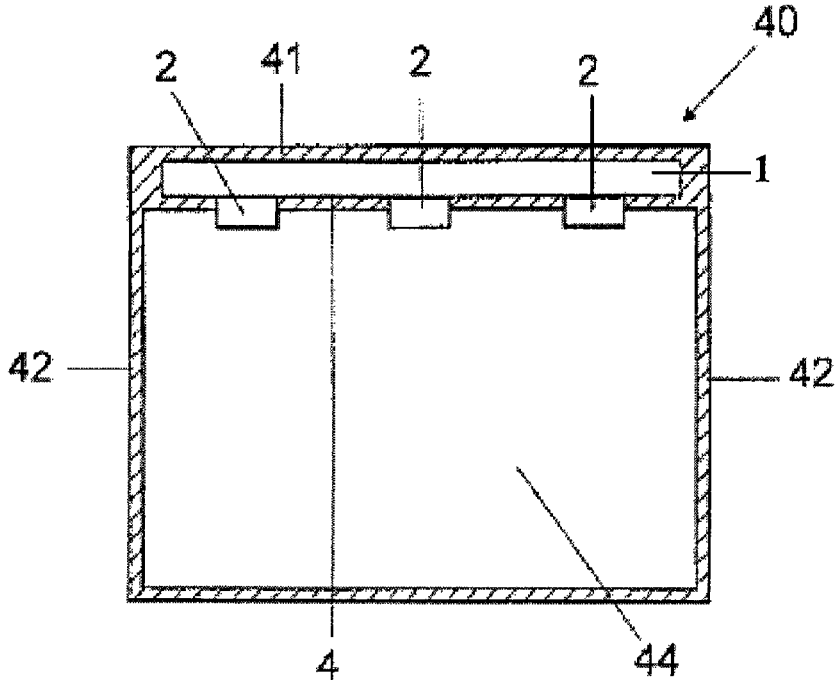
FIGS. 4A and 4B shown schematic profiles of embodiments of rooms with devices.

The exemplary embodiment according to FIG. 4A shows a room 40 that has a ceiling 41, walls 42, a floor 43 and a useable area 44. A device with a temperature control system 1 and a lighting system 2 according to the above exemplary embodiments can be integrated into the ceiling 41 with the lighting system having a plurality of individual lighting units. The lighting system 2 may be used to light the useable area 44. To this end the lighting system 2 may be mechanically fastened to or integrated into the ceiling 41 and/or to the temperature control system 1. A ceiling 41 with an integrated temperature control system 1 also may be known as a climate control ceiling. The lighting system 2 may be in direct contact with the temperature control system or can be in thermal contact with the temperature control system via a conveyor 5 according to the exemplary embodiment in FIG. 1B. It can be advantageous if the waste heat generated by the lighting system during operation is largely or wholly carried off to the temperature control system. Alternatively the ceiling 41 may form part of the temperature control system. The waste heat carried off by the lighting system may be supplied to the room 40, in particular the useable area 44, via surface 4 of the temperature control system. Thus the waste heat of the lighting system may be used to heat the room 40 and in particular the useable area 44. The embodiment of the temperature control system 1 and the lighting system 2 can correspond to the device 10 described in connection with FIG. 3.

Figure 4B:
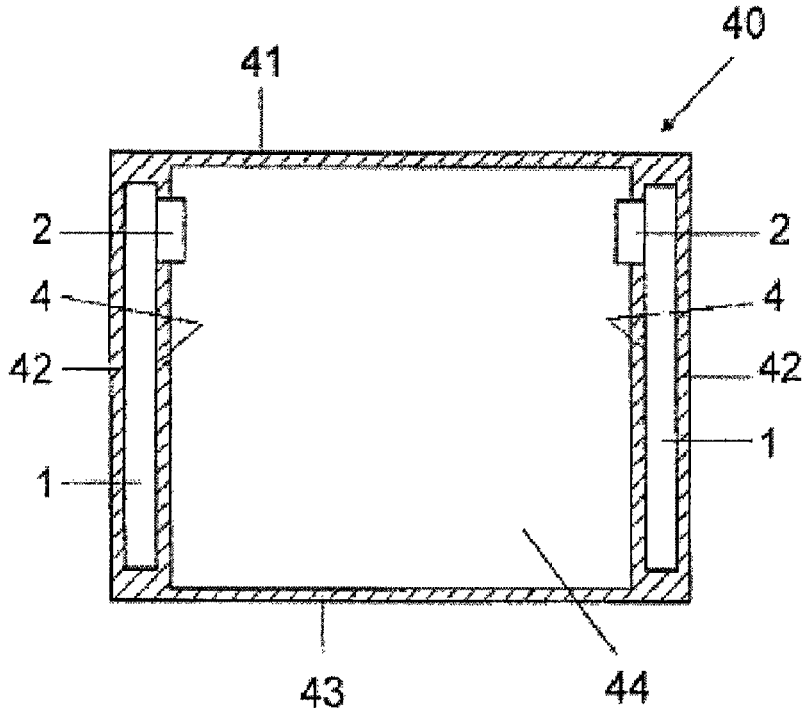

The exemplary embodiment according to FIG. 4B shows a variation of the room 40 in which the temperature control system 1 and the lighting system 2 are integrated into the walls 42.

The invention is not limited by the descriptions of the exemplary embodiments. Rather, the invention includes each new characteristic as well as each combination of characteristics which in particular includes each combination of characteristics in the claims, embodiments and exemplary embodiments even if a characteristic or combination of characteristics is not explicitly indicated in the claims or exemplary embodiments.

What is claimed is:

1. A device for controlling room temperature and room lighting, comprising:

a room temperature control system that decreases a temperature of an area surrounding the system by receiving heat from the area surrounding the system and that increases the temperature by delivering heat to the surroundings; and a lighting system thermally coupled to the room temperature control system.

2. A device according to claim 1, wherein during operation the lighting system supplies waste heat to the temperature control system.

3. A device according to claim 1, wherein the lighting system comprises a housing with at least one light-emitting means and an opening through which light is radiated to the surroundings and a cover over the opening that is at least partially transparent to visible light but reflects heat.

4. A device according to claim 1, wherein the lighting system comprises light-emitting diodes.

5. A device according to claim 1, wherein the room temperature control system is configured to transfer heat to the surroundings across a large area.

6. A device according to claim 1, wherein transfer of heat is accomplished through convection or air flow.

7. A device according to claim 1, wherein the room temperature control system is integrated into a ceiling or a wall of a room.

8. A device according to claim 1, wherein the room temperature control system is in direct contact with the lighting system.

9. A device according to claim 1, further comprising a thermal coupler coupling the room temperature control system to the lighting system, wherein the thermal coupler is a material with heat conduction properties.

10. A device according to claim 9, wherein the thermal coupler conductor comprises a heat transporting medium.

11. A device according to claim 1, further comprising a thermal coupler coupling the room temperature control system to the lighting system, wherein the thermal coupler employs convection or creates an air flow.

12. A room comprising the device of claim 1 for controlling the temperature and lighting.

13. A room according to claim 12, wherein the device is integrated into a ceiling or into a wall.

14. A room according to claim 12, wherein the lighting system is integrated into a wall or ceiling in the room.

15. A room according to claim 12, wherein light emitted by the lighting system is radiated into a reflecting cavity to form reflected light and the reflected light is directed out of the lighting system.

16. A room according to claim 15, wherein:

the lighting system comprises at least two light emitting means that emit light with different wavelengths from one another; and the reflected light is a combination of the different wavelengths of light.

17. A method of heating a room with the lighting system of claim 1, comprising:

operating the lighting system to cause the lighting system to deliver heat to the room temperature control system; and operating the temperature control system to deliver heat the room.

18. A method of according to claim 17, wherein operating the room temperature control system includes delivering heat to a room across a large area by the temperature control system.

19. A method of heating according to claim 17, wherein operating the room temperature control system to deliver heat to the room comprises using only heat generated by the lighting system.

20. The device of claim 1, wherein a heat exchange area of the device is greater than four square feet.

* * * * *

UNITED STATES PATENT AND TRADEMARK OFFICE

CERTIFICATE OF CORRECTION

PATENT NO. : 7,784,962 B2
APPLICATION NO. : 11/748290
DATED : August 31, 2010
INVENTOR(S) : Jens Florian Hockel and Harald Stoyan It is certified that error appears in the above-identified patent and that said Letters Patent is hereby corrected as shown below:

In Claim 17, at column 10, line 16, after "heat" insert -- to --.

In Claim 18, at column 10, line 18, delete "of".

Signed and Sealed this

Twenty-third Day of November, 2010

David J. Kappos

David J. Kappos
*Director of the United States Patent and Trademark Office*